US006850857B2

(12) United States Patent
Ignagni et al.

(10) Patent No.: US 6,850,857 B2
(45) Date of Patent: Feb. 1, 2005

(54) DATA FUSION OF STATIONARY ARRAY SENSOR AND SCANNING SENSOR MEASUREMENTS

(75) Inventors: Mario Ignagni, St. Paul, MN (US); Dimitry Gorinevsky, Palo Alto, CA (US)

(73) Assignee: Honeywell International Inc., Morristown, NJ (US)

( * ) Notice: Subject to any disclaimer, the term of this patent is extended or adjusted under 35 U.S.C. 154(b) by 369 days.

(21) Appl. No.: 09/903,733

(22) Filed: Jul. 13, 2001

(65) Prior Publication Data

US 2003/0014147 A1 Jan. 16, 2003

(51) Int. Cl.[7] ..... G01D 18/00

(52) U.S. Cl. ..... 702/104; 702/33; 702/36; 342/378; 250/559.19; 700/130; 700/140; 73/1.45; 73/1.49; 73/767; 356/478

(58) Field of Search ..... 702/33, 34, 36, 702/40, 81–84, 97, 104, 170, 105, 166, 167, 113, 127, 150, 152, 155, 158, 190, 197, FOR 123, 124, 134, 136, 141, 144–148, 164; 342/378, 195; 250/559.19, 559.4; 700/130, 140; 708/5, 814; 73/1.45, 1.49, 33, 1.85, 767; 356/478

(56) References Cited

U.S. PATENT DOCUMENTS

| | | | | |
|---|---|---|---|---|
| 4,903,528 A | | 2/1990 | Balakrishnan et al. | |
| 4,931,982 A | * | 6/1990 | Hayashida et al. | 364/473 |
| 4,965,736 A | | 10/1990 | Balakrishnan | |
| 5,071,514 A | | 12/1991 | Francis | |
| 5,121,332 A | | 6/1992 | Balakrishnan et al. | |
| 6,091,361 A | * | 7/2000 | Davis et al. | 342/378 |
| 6,168,687 B1 | | 1/2001 | Hu et al. | |
| 6,491,792 B2 | * | 12/2002 | Shakespeare et al. | 162/263 |
| 6,526,369 B1 | * | 2/2003 | Meinecke et al. | 702/170 |

FOREIGN PATENT DOCUMENTS

| | | |
|---|---|---|
| DE | 199 13 926 A1 | 3/1999 |
| EP | 0 276 106 A3 | 7/1988 |
| EP | 0 276 106 A2 | 7/1988 |

OTHER PUBLICATIONS

Deguchi, "An Algebraic Framework for Fusing Geometric Constrints of Vision and Range Sensor Data", Oct. 1994, IEEE , pp.: 329–336.*

"Estimation of Cross–Directional Properties: Scanning vs. Stationary Sensors", Tyler, Matthew L. et al., AIChE Journal, vol. 41, No. 4, Apr. 1995, pp. 846–854.

European Search Report, dated Feb. 14, 2003, relative to EPO application No. 02255838.1–2314–, the foreign equivalent to the instant U.S. Appl. No. 09/903,733.

* cited by examiner

*Primary Examiner*—Marc S. Hoff
*Assistant Examiner*—Elias Desta
(74) *Attorney, Agent, or Firm*—Thelen Reid & Priest LLP

(57) ABSTRACT

The present invention is directed to improving the accuracy with which a stationary array sensor provides cross directional measurements by providing an offset compensation to the stationary array sensor using the output of a scanning sensor associated with the manufacturing process. Exemplary embodiments correlate outputs from the stationary sensor array and the scanning array using a data reconciliation process. For example, a practical, real time data reconciliation of measurements from the scanning sensor and measurements from the stationary array sensor is achieved by computing offsets using a bank of Kalman filters to correlate outputs from the two sensors for each measurement zone, wherein each filter possesses a relatively simple computational structure. The Kalman filters can fuse the outputs from the stationary array sensor and the scanning sensor to track, and compensate, drift of the stationary array sensor.

16 Claims, 7 Drawing Sheets

DATA FUSION OF STATIONARY ARRAY SENSOR AND SCANNING SENSOR MEASUREMENTS

BACKGROUND OF THE INVENTION

1. Field of the Invention

This invention generally addresses the cross directional control of a process, such as a paper manufacturing process. The invention can improve the accuracy of a stationary array sensor employed for cross directional control by fusing the sensor output with the output of a scanning gauge, or sensor, using a bank of filters such as Kalman filters, where each filter in the bank has a simple computational structure.

2. Background Information

Cross directional (CD) control of processes, such as paper manufacturing processes, is known. For example, U.S. Pat. No. 4,903,528 entitled "System and Process For Detecting Properties Of Traveling Sheets In Cross Direction", U.S. Pat. No. 4,965,736 entitled "Cross-Directional Control Of Sheetmaking Systems" and U.S. Pat. No. 5,121,332 entitled "Control System For Sheetmaking", the disclosures of which are all hereby incorporated by reference, are directed to cross directional control using a scanning sensor. A document entitled "Estimation of Cross-Directional Properties: Scanning vs. Stationary Sensors", Tyler, Matthew L. et al., AIChE Journal, Vol. 41, No. 4, April 1995, pages 846–854 also discusses cross-directional control of a process using a scanning sensor. The scanning sensor is used to perform process measurements in the cross direction of a moving sheet of paper. The measurements serve as feedback for control over some property, such as basis weight, moisture content or coating thickness, to render the property uniform across the moving sheet of paper.

Because scanning sensors move back and forth across the paper sheet as it moves in a machine direction (MD), cross directional variations are not measured directly. Cross directional variations in a property to be measured can occur at a non-negligible rate relative to the speed of MD paper movement and the scan rate of the scanning sensor. Because the profile data associated with a scanning sensor is available only once per scan cycle, the scanning sensor's scan rate can be too slow to adequately address the dynamics of cross directional variations of the process property being controlled.

Newer technologies have been proposed to provide faster sensing of the cross-directional properties of a product, such as the paper sheet in a paper manufacturing process, by using a stationary array sensor. A stationary array sensor includes a plurality of sensors located adjacent to one another in the cross direction, each sensor providing an approximately instantaneous measurement of a given property of the paper at a location across the paper's width. Although stationary array sensors avoid the need of a cross directional scan using motion of a single sensor back and forth over the moving paper sheet, the requirement that the stationary array sensor includes a plurality of individual sensors can render it quite expensive. For example, a stationary array sensor associated with a paper manufacturing process can require on the order of three hundred sensors to cover a sufficient width of the paper. This need for a large number of individual sensors in the stationary sensor array renders it cost prohibitive to include sensors having a high degree of precision. That is, to provide a stationary sensor array that can achieve measurements with an accuracy that approaches the accuracy of measurements achieved with a scanning sensor, expensive individual sensors must be used.

It is also desirable to use stationary sensor arrays at locations in a manufacturing process which are unsuitable for scanning sensors. Again, in these circumstances, the stationary sensor array is typically configured with sensors that render the array cost competitive with scanning sensors used at other locations in the process. For example, stationary sensors are used in the earlier stages of a paper manufacturing process where the presence of flying debris, such as warm paper pulp, could jam the scanning mechanism of a scanning sensor. To achieve maximum benefit from the fast stationary array sensor measurement, such sensors would be used in close proximity to the actuators. Scanning sensors are commonly used in the end of the process, downstream from the actuator such that they measure properties of the finished product for quality control purposes.

In addition to the use of less expensive, less accurate sensors in stationary sensor arrays, another factor which detracts from the quality of the measurements they provide is their susceptibility to drift. Although the sensors of stationary sensor arrays and scanning sensors can both experience drift, it is relatively easy to recalibrate a scanning sensor at least once during each scanning cycle. For example, the scanning sensor can be recalibrated during each cycle by moving it to a location off the paper being produced. Such a recalibration cannot be easily achieved with stationary sensor arrays, wherein each of the sensors is fixed in position.

Thus, processes such as paper manufacturing processes and coating processes which involve cross-directional control, are known which use both stationary sensor arrays and scanning sensors at various locations in the paper production process. It would be desirable to improve the accuracy of a stationary array sensor such that the quality of the measurement provided thereby is comparable to or exceeds that of a scanning sensor without rendering the stationary sensor array substantially more costly than a typical scanning sensor,

SUMMARY OF THE INVENTION

The present invention is directed to improving the accuracy with which a stationary array sensor provides cross directional measurements by periodically providing an offset compensation to the stationary array sensor using the output of a scanning sensor associated with the same manufacturing process. Exemplary embodiments correlate outputs from the stationary sensor array and the scanning array using a data reconciliation process. For example, a practical, real time data reconciliation of measurements from the scanning sensor and measurements from the stationary array sensor is achieved using a bank of Kalman filters to correlate outputs from the two sensors for each cross-directional measurement zone, wherein each filter possesses a relatively simple, computational structure. The Kalman filters can fuse the outputs from the stationary array sensor and the scanning sensor to track, and compensate, drift of the stationary array sensor.

Generally speaking, the invention relates to a measurement system comprising: at least one stationary array of sensors at a first location to produce a first array of measurement outputs; at least one scanning sensor at a second location to produce a second array of measurement outputs; and means for synthesizing an array of measurement outputs by fusing (reconciling) the first and second arrays of measurement outputs. The invention is also directed at an associated method for fusing cross directional data measurements obtained from plural locations in a product manufacturing process.

Exemplary embodiments compare and reconcile stationary array and scanning measurements so that the measurements can be correlated to the same spot on the manufactured material, such as paper. For example, measurements can be obtained which comprise time stamp information, cross direction coordinates, machine direction coordinates, and machine direction odometer or velocity information.

The synthetic measurement can be obtained by computing a corrective offset (e.g., bias) updated by a recursive least mean square algorithm (e.g., update a bias model). For example, a filter, such as a bank of Kalman filters, can be used as the recursive least mean square algorithm to output data. The filter can be configured to compensate for different sensor inputs and bias errors. The filter can also compensate for the temporal variations in the biases of an array of stationary sensors. Data measurements obtained from stationary and scanning sensors can be compared by the filter, and an offset compensation for the drift of the stationary array sensor calculated.

DESCRIPTION OF THE DRAWINGS

The present invention will now be described by way of exemplary embodiments as illustrated in the following drawings.

DETAILED DESCRIPTION OF THE PREFERRED EMBODIMENT

The present invention relates to a measurement system, and associated method, which can be applied to any manufacturing process. For example, FIG. 1 illustrates a measurement system for use with a paper production process wherein, according to exemplary embodiments of the present invention, data measurements obtained from plural locations using different types of sensors are fused.

Figure 1:
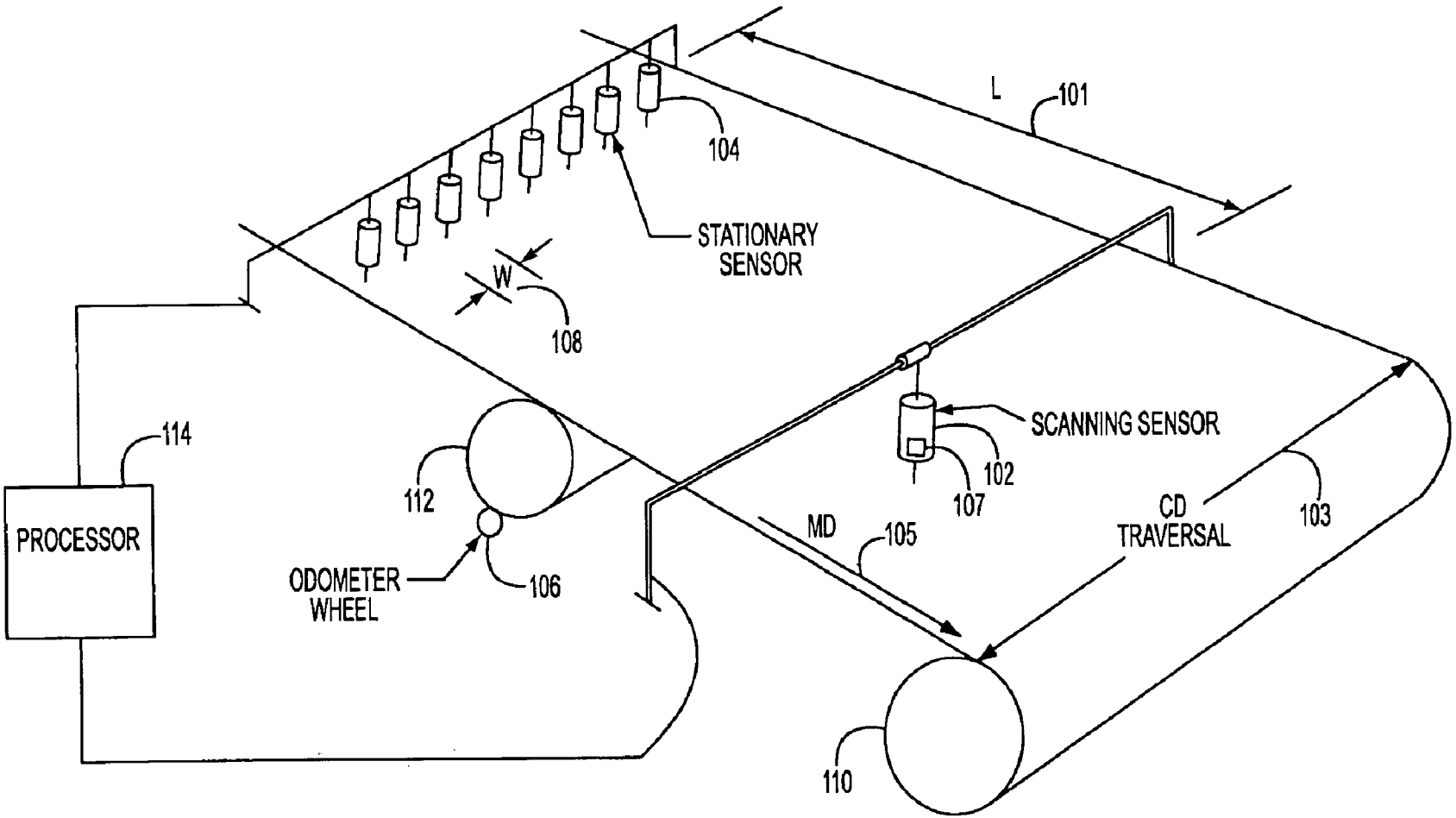
FIG. 1 is diagram of a paper production monitoring scheme and measurement setup.

Referring to FIG. 1, a measurement system is illustrated for measuring a variable of at least one property of a product, such as a paper web, and including at least one stationary sensor and one scanning sensor. A stationary sensor shown in FIG. 1 can be a stationary sensor array 104 provided at a first location in the manufacturing process to produce a first array of measurement outputs.

FIG. 1 also illustrates measuring the variable of the product and/or process with a scanning sensor such as scanning sensor 102. The scanning sensor 102 is located at a second location in the manufacturing process to produce a second array of measurement outputs. The FIG. 1 measurement system includes means for synthesizing an array of measurement outputs by fusing the first and second arrays of measurement outputs using, for example, a synthesizing means represented in FIG. 1 as a processor 114.

The processor 114 can fuse the outputs using a recursive least mean square algorithm implemented using a filter, such as a Kalman filter, to compute and/or update a corrective offset (e.e., update bias model). Although Kalman filters are known for fusing the measurements of different types of sensors, they have not been used to fuse the output of a stationary array sensor with a scanning sensor in manufacturing processes. The aforementioned Tyler et al paper mentions use of Kalman filtering when adding additional sensors to improve the estimation and control of a cross-directional property measured using a scanning gauge. However, this document does not discuss using a scanning sensor to provide periodic off-set compensation for the measurement provided by a stationary array sensor, nor does it describe a Kalman filter which could be implemented in a cost-effective, practical fashion as a bank of multiple Kalman filters to achieve real time fusing of the outputs from these different types of sensors.

FIG. 1 illustrates a web having an associated cross direction (CD) 103 and a machine direction (MD) 105. An odometer 106 is used to measure where a point of the web L 101 has moved from a location associated with the stationary sensor array 104 to a location associated with the scanning sensor 102, and to provide MD odometer information. A transducer 107 can be used to output the position of the scanning sensor as it executes a CD traversal of the paper. Those skilled in the art will appreciate that the transducer can be located within the scanning sensor, however it can also be located at any other physical location where it is in operable communication with the scanning sensor. The odometer can be replaced by any device which can provide information representing a measure of movement including, but not limited to, velocity measurements using a web speed sensor and a dead reckoning algorithm.

Figure 2:
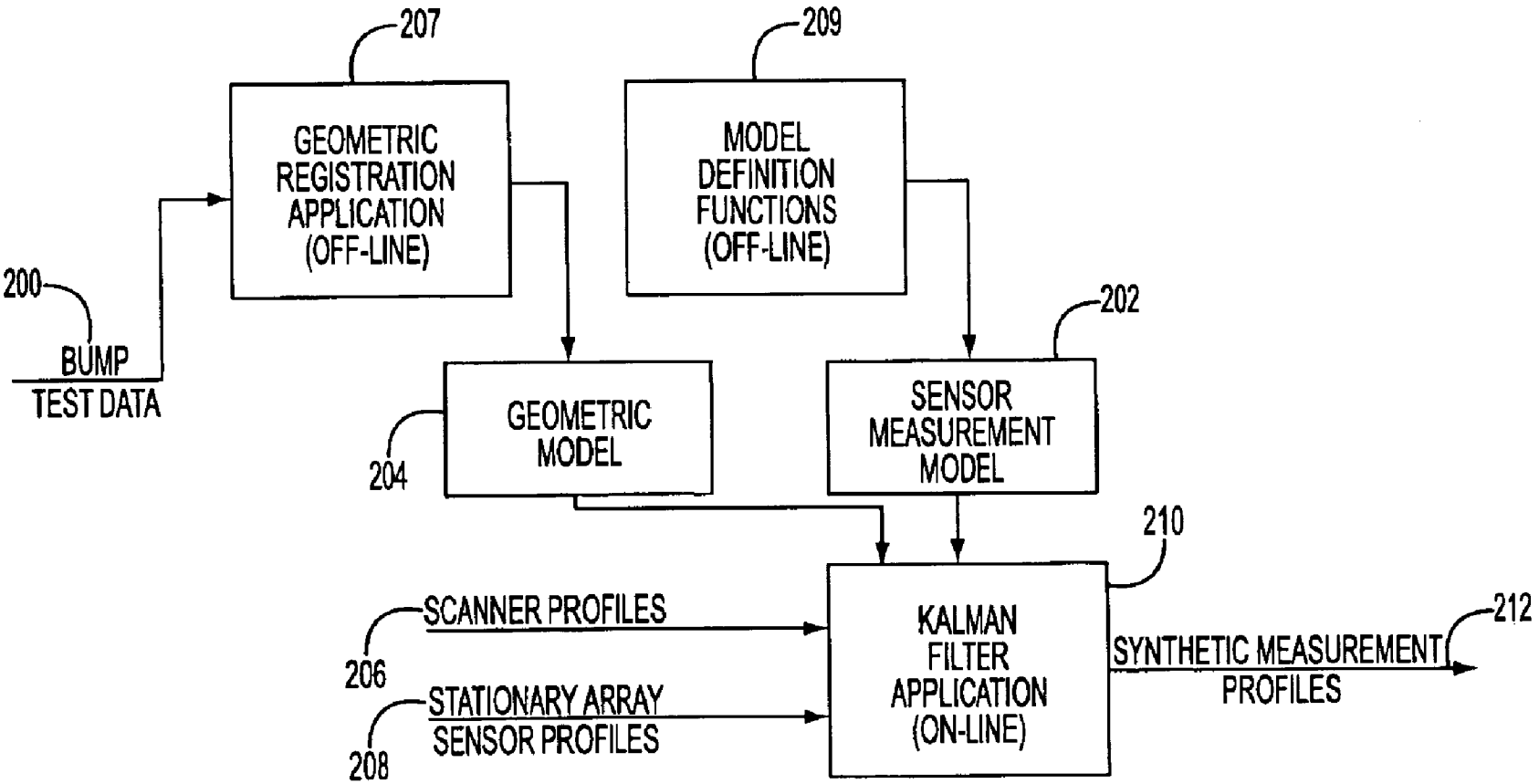
FIG. 2 is an overall system level diagram for the functions of the data fusion application.

FIG. 2 shows an overall system-level diagram of data fusion application functions. The geometric registration application 207 and the model definition function 209, correspond to functions performed off-line. The middle two blocks depicting the geometric model 204 and the sensor measurement model 202 describe parts of the model parameter database and correspond to static data that is not changing during the stationary operation of the manufacturing process. The model parameters define the internal dynamics and characteristics of the on-line Kalman filter application 210. Data from the scanner profiles 206 and the stationary array sensor profiles 208 is also input into the Kalman filter application 210. The resultant output of this process is a synthetic measurement 212 that fuses, or merges, the measurements of the various sensor types found in the manufacturing process.

Figure 3A:
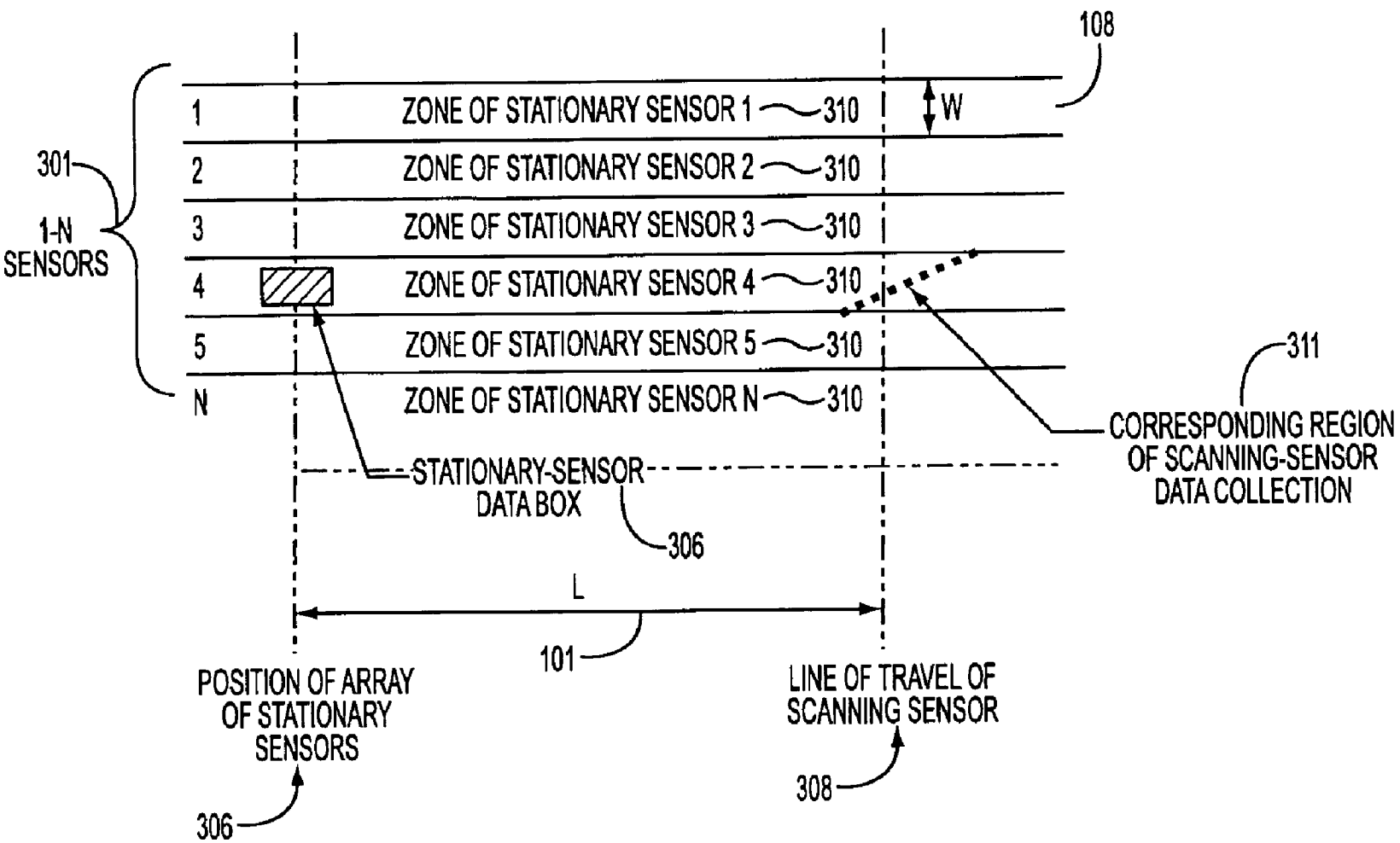
FIG. 3A illustrates one view of sensor measurement geometry.
Figure 3B:
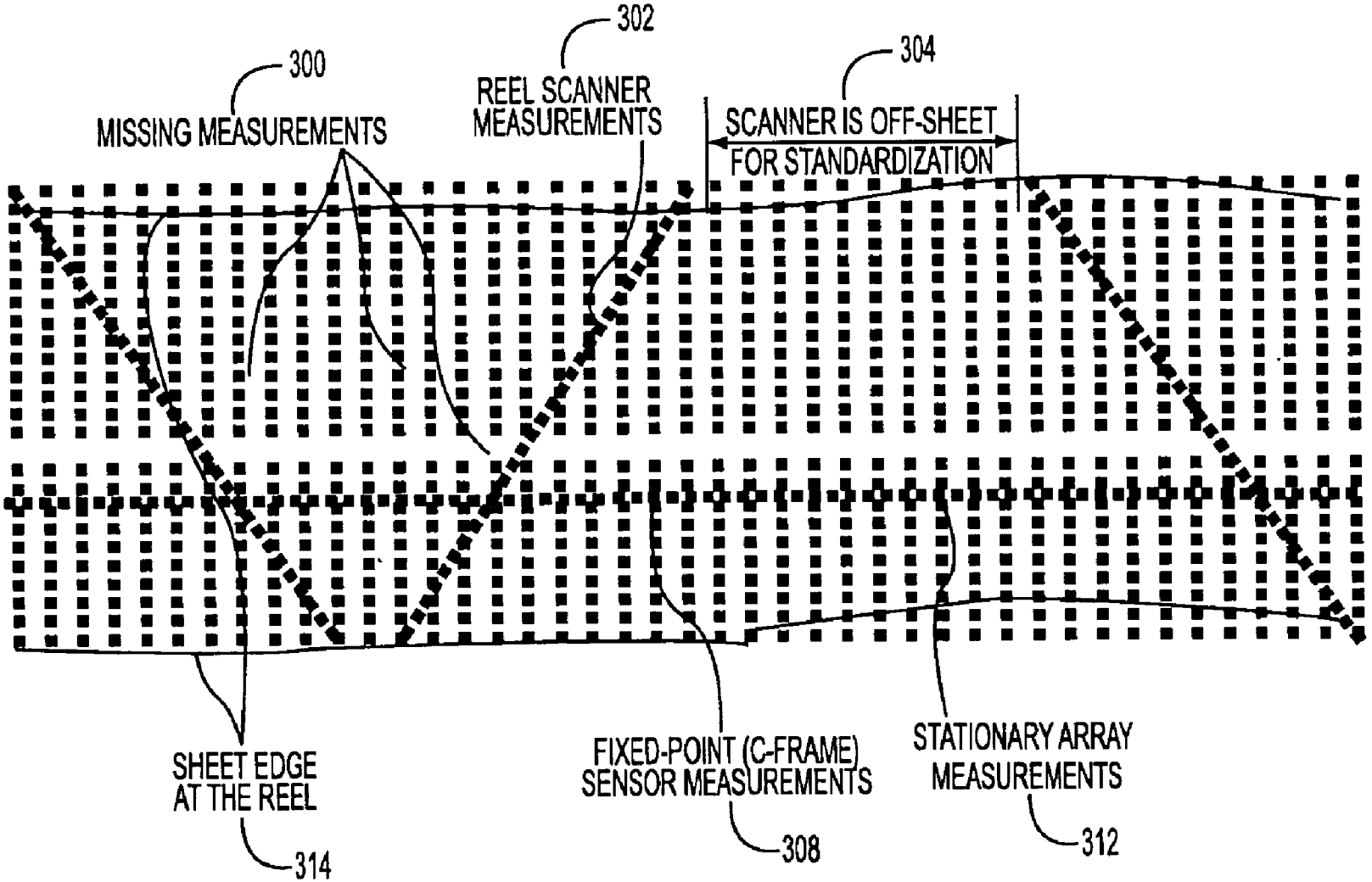
FIG. 3B illustrates another view of sensor measurement geometry.

The sensor measurement geometries that are available from an array of stationary sensors and a scanning sensor are depicted in FIGS. 3A and 3B. The stationary array can include N sensors 301, spaced in the CD direction at a distance w 108. For example, in an exemplary paper manufacturing web process, each stationary sensor measures some paper characteristic, such as thickness, moisture content, coating thickness, or any other quality characteristic. These measurements are taken over a finite CD area, referred to as a data box 306 in FIG. 3A. The stationary sensor measurements are compared with the corresponding measurements made by the scanning sensor. This comparison requires that all measurements be reconciled and synchronized so that measurements made by the two types of sensors are attributed to the same spot on the manufactured paper or the same point of whatever product is being measured.

The measurements associated with each data box are an instantaneous snapshot in time comprising a large number of individual snapshots of the distinct pixels that makeup the data box. These individual pixel measurements are averaged to form a single instantaneous measurement.

Since the paper parameter being measured has no more than a linear spatial variation across the small data box in both CD and MD directions, the average instantaneous output of the stationary sensor will correspond to the parameter value located at the centroid of the data box.

In FIG. 3A, the paper can be divided into N zones 301 corresponding to the number of stationary sensors present in the system, with each zone being equal to the separation w 108, between the centerlines of the stationary sensors. At a downstream distance, L 101, from the line of stationary sensors, the scanning sensor traverses the paper, making a series of measurements of the same paper parameter of interest that the stationary sensor upstream of the stationary sensors had previously made.

The scanning sensor output constitutes a series of discrete measurements of the paper parameter over small areas along a diagonal path 311 that is a function of the paper speed and the rate at which the scanning sensor is moving across the paper. As the scanning sensor crosses the different zones of the paper, a series of discrete measurements obtained in these regions is processed to derive the value corresponding to the midpoint of the zone. Purely random errors that occur in the array of stationary sensor outputs can be significantly attenuated. This is done by taking advantage of the characteristic of the paper parameters to vary in a smooth manner in CD, thereby allowing a moving-window least squares fit yielding a smoothed estimate of the paper parameter as a continuous function of CD position on the sheet, and as a continuous function of time.

FIG. 3B shows another detailed view of the measurement data geometry. As the paper moves through the system the stationary array measurements 312 are taken. A fixed-point sensor measurement C-frame reference 308 is also taken. The sheet edge at the ends of the paper reels are shown by 314. There is also a region 304 where the scanner is moved off-sheet. One reason for moving the scanning sensor off-sheet can be for re-calibrating the sensor. Item 302 shows how the reel scanner measurement moves across the paper in a diagonal or zig-zag direction.

In FIG. 3B, note that there are areas of missing measurements 300 that may occur. However these missing measurements will not prevent the present invention from working. A designer can empirically or experimentally determine what threshold level of missing measurements will result in reduced accuracy and compensate for these missing measurements.

The invention permits direct comparisons to be made with the values measured by the appropriate stationary sensor at the center of that zone. A meaningful comparison would be made with respect to the value measured by the stationary sensor at an earlier point in time when the area of interest was at a distance L, upstream of the scanning sensor. The difference between the two sensor outputs may be used as the basis for continuous identification of the bias errors of the stationary sensors.

Figure 4:
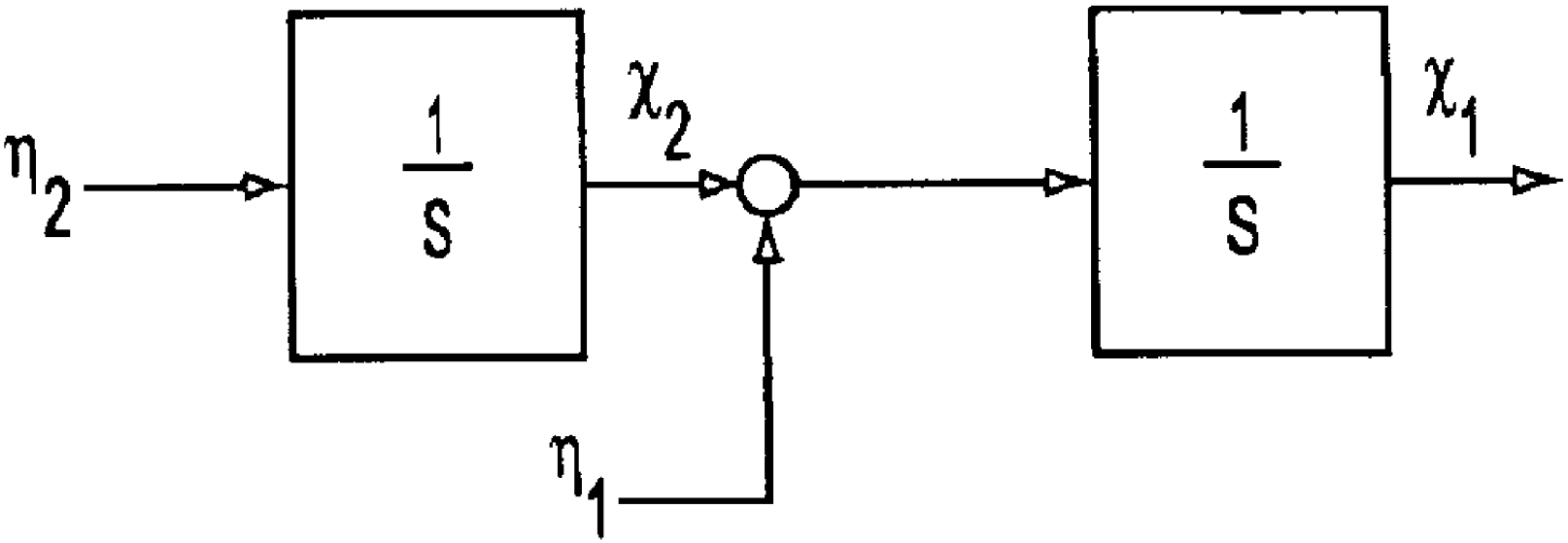
FIG. 4 illustrates a dynamic model for sensor bias.

Configuring a Kalman filter for fusing data measurements requires that an appropriate model for the temporal variations in each stationary sensor bias be defined. It is also useful to employ an approach that achieves maximum flexibility in representing possible variations of sensor bias. FIG. 4 shows a suitable model where two states are used to represent temporal variations in a parameter. For the special case where the state noise inputs $\eta 1$ and $\eta 2$ are zero, the model reduces to a time-varying but non-stochastic function including a fixed offset plus a fixed drift. When the noise terms are activated, the model allows for random temporal variations in both the bias offset and bias drift. The selection of the spectral intensities of $\eta 1$ and $\eta 2$ is based on the expected statistical variation in the bias resulting from temperature variations and other environmental and process factors affecting the variation. This selection affects the filter's ability to track real sensor bias variations without allowing it to become overly responsive.

A Kalman filter application executes on-line each time a new data arrives at the filter input, if there is a request for the filter output, or if there is a system timer request to run this module.

The Kalman filter configuration can be based on a number of the explicit and implicit assumptions about the web process and the data measurements obtained. These assumptions lead to mathematical equations describing the problems to be resolved and the specific form of the algorithms required to solve the problems. These formalized assumptions will be presented as models of the system. The parameters of these models will be stored in an application database and used to define the tuning settings of these algorithms. The assumed models provide an abstraction layer interface between the process and the algorithm design. These models are but one exemplary embodiment of the present invention. Those skilled in the art will realize that other models can be used or the current models can be modified without departing from the spirit and scope of the present invention.

The Kalman filter processes measurements of the differences between the quantities derived from the stationary sensors, and the corresponding quantities derived from the scanning sensor. The Kalman filter can be configured so that all of the information is fused (i.e., merged or integrated) in an optimal fashion.

An effective Kalman Filter implementation includes the following elements. A model for dynamic state variations in the form of differential or difference equations is developed. Especially of interest in this exemplary embodiment are the errors found in the stationary sensor's bias compensation coefficients. In addition to the dynamic state variation model, a model for the random forcing functions is also developed. In this exemplary embodiment, the random inputs produce the random-like temporal variations of the stationary sensor biases. The other areas that must be modeled are the random errors that appear in any measurement equations that are used. In this exemplary embodiment, some examples of random error components are the outputs of the stationary sensor and the scanning sensor, and measurement errors related to paper shrinkage and wandering as the paper moves from the line of stationary sensors to the scanning sensor.

An advantage of using a Kalman filter is that it can process all of the aforementioned data and model parameters in an organized and systematic way, thereby making it suitable for digital computer implementation. It also allows for convenient handling of non-uniform measurement sampling for each zone for the scanning sensor measurement. The following discussion summarizes the steps and mathematics that should be addressed in a Kalman filter implementation.

Consider a system whose behavior is defined by the following set of discrete linear equations:

$$X_n=\Phi_n X_{n-1}+B_n\eta_n \quad (1)$$

where

X=vector of states

η=vector of random (zero-mean) noise sequences $\Phi_n$=state transition matrix from $(n-1)^{th}$ to $n^{th}$ update points $B_n$=noise distribution matrix For a given Φ and B, the state X will have a time variation determined by the particular noise sequence η, and initial condition, $X_0$, which is generally taken to be a randomly distributed quantity. Since the noise sequence, η, has an infinite number of realizations, and the initial condition error can assume an infinite number of values, the system given by (1) has an infinite number of solutions. Because of this, attention is focused on the statistical behavior of Equation (1), rather than on specific solutions.

A natural and useful way of characterizing the behavior of (1) is to compute the statistical parameters that define the bounds on the state vector, X. The statistical bounds on the components of X are found by solving the covariance matrix equation associated with (1), which takes the recursive form:

$$P_n=\Phi_n P_{n-1}\Phi_n^T+B_nQ_nB_n^T \quad (2)$$

where P is the error covariance matrix of the state vector, X, defined explicitly by:

$$P=[P_{ij}]$$

and $$P_{ij}=E(x_ix_j)$$

in which E denotes the expectation operator. It is seen that the individual variances of the components of X are defined by the diagonal elements of P, with the joint expectations being defined by off-diagonal elements of P. The matrix Q in (2) is the covariance matrix of the driving noise vector, η, defined by:

$$Q=[q_{ij}]$$

in which $$q_{ij}=E(\eta_i\eta_j)$$

Consider the case where the discrete process defined by (1) represents the true dynamic propagation characteristics associated with a given linear system. For this case, assume that a measurement is made at the nth measurement update time employing an external measuring device which allows a specific linear combination of the states to be directly monitored. A general way of stating this in mathematical terms is as follows:

$$y_n=H_nX+\xi_n \quad (3)$$

where $y_n$=vector of measurements $H_n$=measurement matrix at $n^{th}$ measurement update time $\xi_n$=measurement noise vector applicable to $n^{th}$ measurement and it is assumed that, in the general case, a number of independent measurements may become available simultaneously.

The optimal utilization of information introduced through a series of measurements of the form given by (3), to estimate the state vector X in a sequential fashion, is the central problem addressed by Kalman estimation theory, and has the following solution. After each measurement (of a sequence of measurements), the estimate of the state, X, is refreshed by the two-step procedure:

$$\hat{X}_n^-=\Phi_n\hat{X}_{n-1} \quad (4)$$

$$\hat{X}_n=\hat{X}_n^-+K_n[y_n-H_n\hat{X}_n^-] \quad (5)$$

where $\hat{X}_n^-$=optimal estimate of vector X just before the $n^{th}$ measurement is processed $\hat{X}_n$=optimal estimate of vector X immediately after the $n^{th}$ measurement is processed $K_n$=Kalman gain matrix at $n^{th}$ measurement update with $K_n$ being defined by $$K_n=P_n^-H_n^T(H_nP_n^-H_n^T+R_n)^{-1} \quad (6)$$

in which $P_n^-$=apriori error covariance matrix of vector X $R_n$=measurement noise error covariance matrix and the apriori error covariance matrix, $P_n^-$, is computed from (2) over the interval $t_{n-1}$ to $t_n$.

After processing the $n^{th}$ measurement, the error covariance matrix of the state X is modified to reflect the benefit of incorporating new information introduced by the measurement as follows:

$$P_n=(I-K_nH_n)P_n^- \quad (7)$$

where $P_n$ is the aposteriori error covariance matrix. The form given by (7) is applicable when the Kalman filter is fully optimal; that is, when it is a full-state filter in which all components of X are fully accounted for in the mathematical model and, further, are re-estimated after each successive measurement is made available.

Another issue is configuring a Kalman filter for the application of interest concerns the definition of an appropriate model for the temporal variations in each stationary sensor bias. An approach is desired that achieves maximum flexibility in representing possible variations in the sensor bias. The modeling of each stationary sensor bias is based upon a two state dynamic model that has been successfully used in other applications. The model is of sufficient generality to allow accurate tracking of slow temporal variations in the stationary sensors. This permits the high-frequency stationary sensor outputs to be compensated in real time to provide the information needed for effective process control. Because each Kalman filter consists of two states, the computational burden associated with cycling a large number of these filters is reasonable.

A model which has been successfully utilized in diverse applications uses two states to represent a temporal variation in a parameter. For the special case in which the state noise inputs ($\eta_1$ and $\eta_2$) are zero, the model reduces to a time-varying but non-stochastic function consisting of a fixed offset plus a fixed drift. When the noise terms are activated, the model allows for random temporal variations in both the bias offset and bias drift. The selection of the spectral intensities of $\eta_1$ and $\eta_2$ is based on the expected statistical variation in the bias resulting from variations in temperature and other environmental factors. This constitutes an important part of the filter specification, since it impacts the filter's ability to track real sensor bias variations without allowing it to become overly responsive.

The state-space model for the stationary sensor bias variation is defined, with the aid of FIG. 3, as follows $$\begin{bmatrix} \dot{x}_1 \\ \dot{x}_2 \end{bmatrix} = \begin{bmatrix} 0 & 1 \\ 0 & 0 \end{bmatrix} \begin{bmatrix} x_1 \\ x_2 \end{bmatrix} + \begin{bmatrix} \eta_1 \\ \eta_2 \end{bmatrix} \tag{8}$$

Given the bias variation model defined by (8), the second major aspect of the Kalman filter that needs to be addressed is the measurement equation and measurement model. As discussed earlier, the output provided by the scanning sensor at the midpoint of each zone is used as the basis of a measurement if it is compared with the appropriate stationary sensor output at the same point on the paper. This is made precise by the following measurement equation $$y_k(s)=q_k^f(s)-q_k^m(s+L) \tag{9}$$

where $y_k(S)$=measurement formed by comparing the output of the $k^{th}$ stationary sensor and the corresponding output of the scanning sensor at the midpoint of the $k^{th}$ zone s=distance traveled by the paper, as indicated by the odometer output L=distance between the array of stationary sensors and the scanning sensor $q_k^f(s)$=output of the $k^{th}$ stationary sensor at a point on the paper $q_k^m(s+L)$=scanning sensor output at the mid-point of the $k^{th}$ zone at a point on the paper a distance L downstream Nominally, the two sensor outputs being compared are equal but, in reality, they will differ due to the stationary sensor bias, and the unavoidable random errors associated with the two sensor outputs. Therefore, the measurement error equation associated with the measurement equation defined by (9) is expressed in the time domain by $$y_k(t)=x_{k_1}(t)+\xi^f-\xi^m \tag{10}$$

where $X_{k_1}$=bias error in the $k^{th}$ stationary sensor at a time, t, corresponding to the odometer reading, s, that existed at the midpoint of the data box where the stationary sensor output occurred $\xi^f$=random measurement noise associated with the stationary sensor m $\xi^m$=random measurement noise associated with the scanning sensor t=time corresponding to the paper distance s The variances assigned to the measurement errors, $\xi^f$ and $\xi^m$, are design parameters of the Kalman filter that represent a tradeoff between the convergence characteristics of the parameter estimation process, and the filter's robustness in the presence of unmodeled (or unexpectedly large) measurement errors. The measurement errors account for the purely random errors in the sensor outputs, as well as errors introduced into the measurement from paper shrinkage and wander that can occur between the two sets of sensor outputs. The H matrix used in the Kalman filter update is defined by H=(1 0).

The sensor measurement model will describe statistical characteristics of the measurement error in a compact form. It is assumed that the error is an output of a linear coloring filter driven by white Gaussian noise. The errors in the neighboring CD locations might be correlated with the cross covariance depending on the difference of the CD coordinates only and vanishing if this difference is large. In the initial stage, the coloring noise filter and the covariances will be set up empirically. At later stages, it might be possible to determine measurement models by analyzing on-line data and laboratory sensor calibration data.

The process variation model describes the assumptions about the process change in time and CD coordinates. The process variation model will be shared among the different sensors (scanning and stationary) providing the measurements for the same process. An exemplary model is to assume that the measured paper property (e.g., weight) is random and independent in all points with different CD and MD coordinates. It is well-recognized that there is a correlation between the paper properties in the neighboring measurement locations.

The geometric model defines relative position of the measurement datapoints obtained by different sensors as CD and MD. It can be assumed that the instantaneous measurement coordinates for the stationary array and the scanner are related through an affine transformation in CD coordinate and fixed MD offset. A CD coordinate of each measurement can be computed through databox width sensor and a CD offset of this sensor. When computing the MD coordinates, additional machine (e.g. paper motion) speed and a time stamp for each measurement point can be taken into account. The relative CD offset of the sensors, the affine transformation defined by the paper sides wandering as it moves through the machine and the paper parameter variance (e.g. shrinkage) between the sensors. The MD distance between the sensors is not known accurately. Therefore these parameters need to be determined by processing data from an identification data set collected in a controlled experiment, such as a CD actuator bump test, to serve as a reference point.

Figure 5:
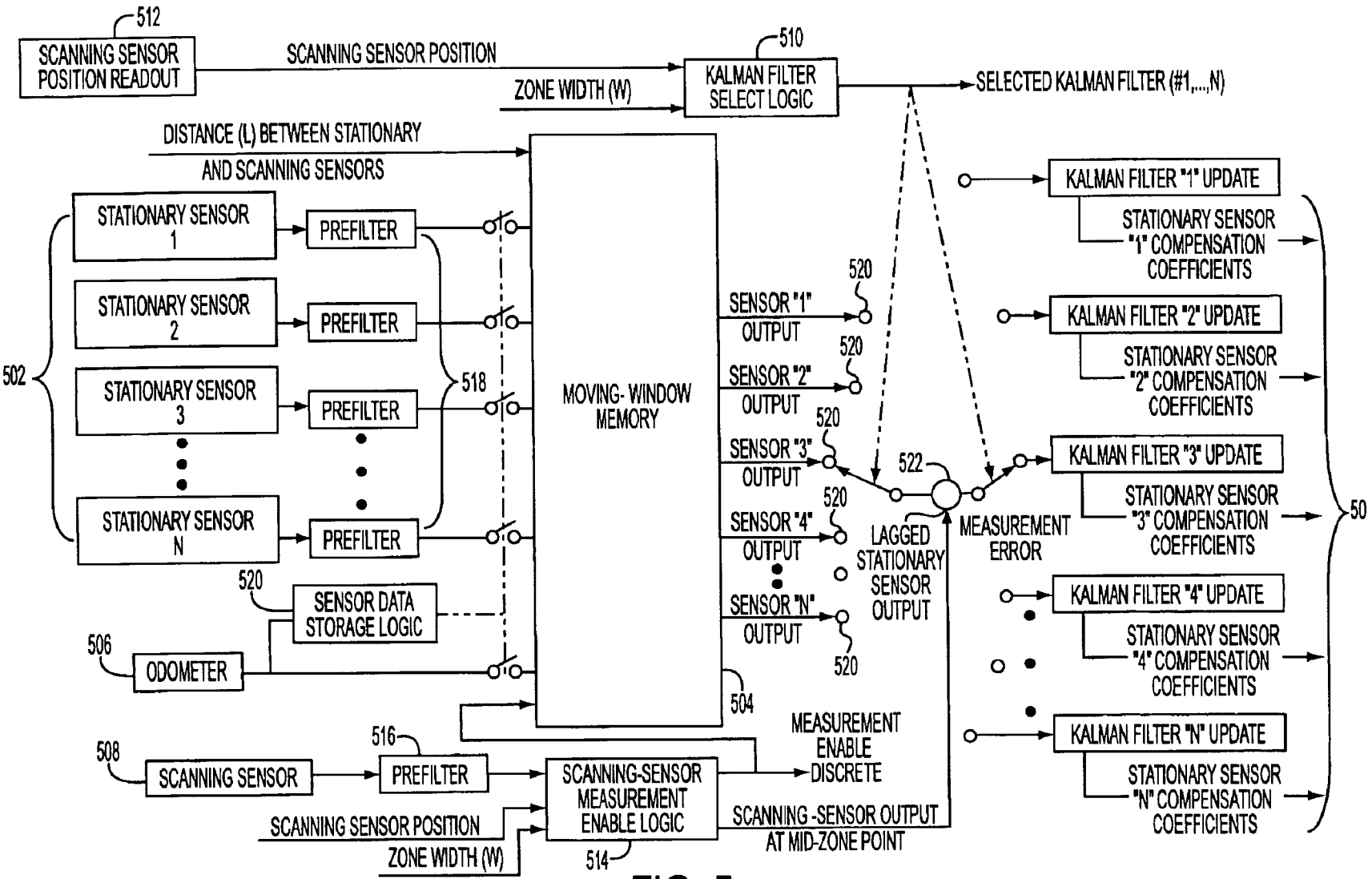
FIG. 5 illustrates a stationary sensor bias identification concept.

FIG. 5 shows one exemplary way of identifying biases in the array of stationary sensors 502. The outputs of stationary sensors 502 and a scanning sensor 516 are digitally pre-filtered to reduce noise before being utilized. A first-order lag filter would constitute a good pre-filter (518 for the stationary sensors and 516 for the scanning sensor). The same filter time constant should be used for all sensor outputs to avoid dynamic mismatch problems.

An output from an odometer (106 of FIG. 1) controls the storage of the stationary sensor data in a moving-window memory 504. The storage interval should be selected to allow accurate interpolation of the discrete data in the later processing stages. This should not be too fine an interval, since this has a major impact on the required size of a storage device and the time required to refresh the memory in a moving-window fashion.

The sensor outputs 520 from the moving window memory are processed 522 by the respective Kalman filter in view of lagged stationary sensor outputs and measurement error. For example, the Kalman filter "1" update is applied to sensor "1" output.

The moving-window memory is the means by which sensor outputs occurring at different points in time may be reconciled. The measurement of the paper characteristic obtained by the scanning sensor at the mid-point of a zone can be compared to the corresponding output of the appropriate stationary sensor by simply going backward in the memory a distance L, using interpolation as required in order to arrive at synchronized measurements between the points.

The moving-window memory stores the outputs of each stationary sensor at a specified increment of paper travel. The window size can be equal to, or greater than, the distance L between the array of fixed sensors and the line of travel of the scanning sensor. As each new set of sensor data is stored, the oldest set of data is eliminated from the memory and replaced by the new data.

The scanning sensor position readout is used to control the selection of the Kalman filter to be updated based on the known zone width, w.

The use of a bank of Kalman filters 501 to establish the gain and covariance matrices for each of the N stationary sensors allows the greatest flexibility in filter operation. This enables the system to deal with missing measurements, unequal update intervals for the various filters, failed sensors, etc. In FIG. 5 it is assumed that each filter is self-contained and can perform all the computations associated with the filtering process. It should be noted that the present invention suggests real-time operation, as each successive scanning sensor measurement becomes available. In practice, the scanning sensor may store and output data for a complete CD traversal rather than as a sequence of measurements.

Additional memory for the collection of scanning sensor data is required and some additional logic allowing the measurements to be processed in the desired sequence needs to be added. The identification process defined above refreshes the bias compensation coefficients for the N stationary sensors at a rate equal to that of the scanning sensor as it traverses the paper in CD. This update rate is normally sufficient to allow tracking of the sensor bias temporal variations. Therefore, in a relatively short time the stationary sensor outputs will be accurately compensated for their bias errors. This leaves only the unavoidable purely random measurement error associated with each stationary sensor.

To address this error component, assume that the paper parameter of interest varies in a relatively smooth manner in the CD at any point along the direction of travel of the paper. Consequently, by assigning a polynomial function to the CD variation, and using the noisy, but bias-corrected outputs of the array of stationary sensors in least-squares fit, the effect of sensor noise can be attenuated. This is accomplished at the expense of a curve-fit error associated with the limitations of a given polynomial function to accurately represent the CD variation of the paper parameter of interest.

Figure 6:
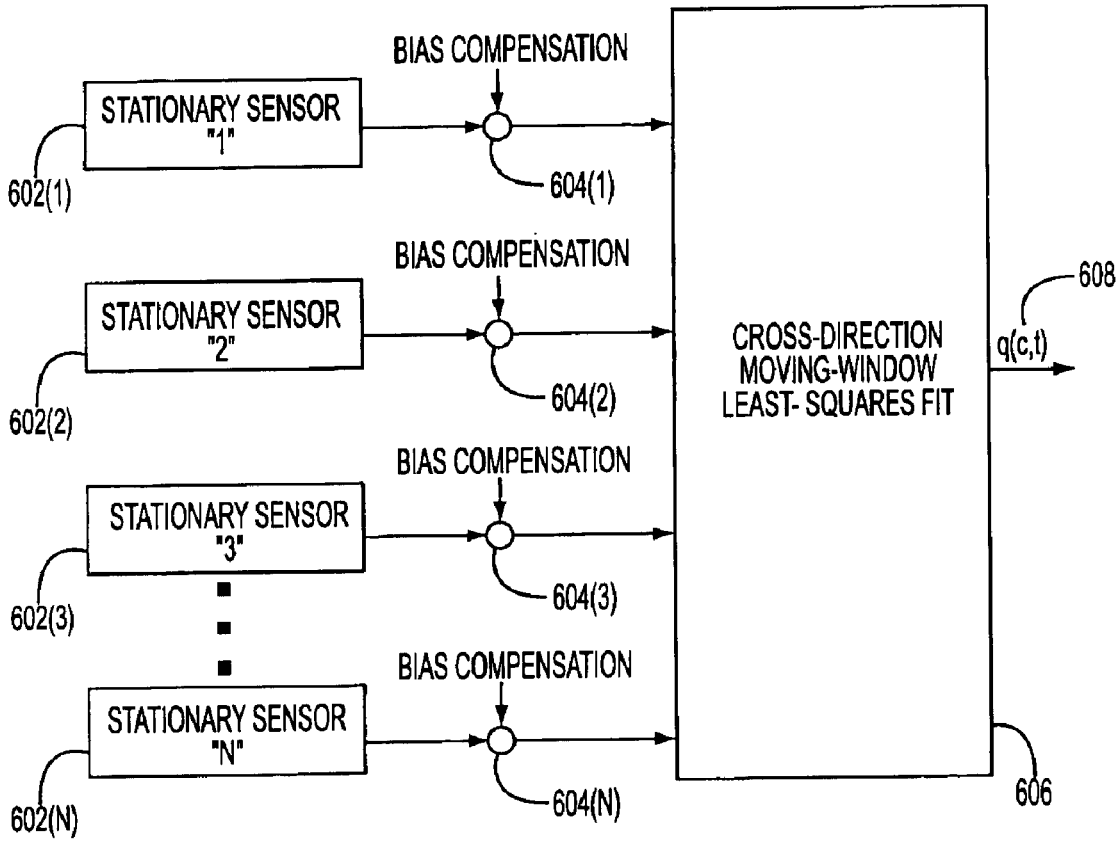
FIG. 6 illustrates moving-window least-squares processing to derive continuous CD paper parameter variations as a function of time.

A solution should balance the residual effect of sensor random measurement noise and curve-fit error is possible by defining a moving-window least-squares fit that limits the CD window size over which the fitting function is used to represent the variations of paper parameters. In FIG. 6, the outputs of the stationary sensors 602(1), 602(2), 602(3) and 602(N) are input into their corresponding bias compensator 604(1), 604(2), 604(3) and 604(N). The output of the moving-window least-squares fit 606 is the function q(c,t) 608 which defines the paper parameter, q, as a continuous function of CD position, c, and time, t.

Although the present invention has been shown and described with reference to exemplary embodiments, it will be understood by those skilled in the art that various other changes in the form and details may be made therein without departing from the spirit and scope of the invention. The invention can be used in any manufacturing process, in addition to the paper manufacturing process disclosed as an exemplary embodiment.

What is claimed is:

1. A measurement system comprising:

at least one stationary array of sensors at a first location to produce a first array of measurement outputs which are each associated with a sensor in the array;

at least one scanning sensor at a second location to produce a second array of measurement outputs which are all associated with one or more sensors of the scanning sensor; and means for synthesizing an array of measurement outputs by fusing the first and second arrays of measurement outputs.

2. The measurement system of claim 1, wherein the stationary and scanning measurements are compared and reconciled so that the measurements made by a plurality of sensors are attributed to the same point on material that is being measured.

3. The measurement system of claim 1, wherein the measurements comprise time stamp information, cross direction coordinates, machine direction coordinates, and at least one of machine direction odometer or velocity information.

4. The measurement system of claim 1, wherein the synthetic measurement is provided by computing an offset using a recursive least mean square algorithm.

5. The measurement system of claim 4, wherein the recursive least mean square algorithm is a Kalman filter.

6. The measurement system of claim 5, wherein the Kalman filter output data is used to compensate for different sensor inputs and bias errors.

7. The measurement system of claim 5, wherein the Kalman data is used to compensate for the temporal variations in the biases of an array of stationary sensors.

8. The measurement system of claim 1, wherein data measurements from stationary and scanning sensors are compared by a Kalman filter and an offset compensation for the sensor measurement drift is calculated.

9. A method for fusing data measurements obtained from plural locations in a product manufacturing process comprising:

measuring a variable of at least one of the product properties and the process with at least one stationary sensor at a first location in the manufacturing process to produce a first output;

measuring the variable of at least one of the product properties and the process with a scanning, non-stationary sensor at a second location in the manufacturing process to produce a second output; and producing a synthetic measurement by fusing the first and second outputs.

10. The method of claim 9, wherein the stationary and scanning measurements are compared and reconciled so that the measurements made by a plurality of sensors are attributed to the same spot on material that is being measured.

11. The method of claim 10, wherein the measurements comprise time stamp information, cross direction coordinates, machine direction coordinates, and at least one of machine direction odometer or velocity information.

12. The method of claim 9, wherein the synthetic measurement is provided using an offset computed by a recursive algorithm.

13. The method of claim 12, wherein the recursive algorithm is a Kalman filter.

14. The method of claim 13, wherein the Kalman filter uses different sensor inputs and computes bias errors.

15. The method of claim 13, wherein the Kalman filter computes the temporal variations in the biases of an array of stationary sensors.

16. The method of claim 9, wherein data measurements from stationary and scanning sensors are compared by a Kalman filter and an offset compensation for the sensor measurement drift is calculated.

* * * * *